US007607397B2

(12) United States Patent
Berg

(10) Patent No.: US 7,607,397 B2
(45) Date of Patent: Oct. 27, 2009

(54) DEVICE FOR A WIGGLE-FREE TABLE

(76) Inventor: Lennart Berg, Ullangergatan 5, 8tr, 162 54 Vallingby (SE)

( * ) Notice: Subject to any disclaimer, the term of this patent is extended or adjusted under 35 U.S.C. 154(b) by 0 days.

(21) Appl. No.: 11/575,592

(22) PCT Filed: Oct. 5, 2005

(86) PCT No.: PCT/US2005/035726

§ 371 (c)(1),
(2), (4) Date: Mar. 20, 2007

(87) PCT Pub. No.: WO2006/041860

PCT Pub. Date: Apr. 20, 2006

(65) Prior Publication Data

US 2007/0272638 A1 Nov. 29, 2007

(30) Foreign Application Priority Data

Oct. 11, 2004 (SE) ..... 0400994

(51) Int. Cl.
*A47F 5/12* (2006.01)

(52) U.S. Cl. ..... 108/8; 108/132; 248/188.2

(58) Field of Classification Search ..... 108/7, 108/6, 1, 8, 129, 132, 119, 120, 116; 248/166, 248/188.2, 188.6
See application file for complete search history.

(56) References Cited

U.S. PATENT DOCUMENTS

| | | | | | |
|---|---|---|---|---|---|
| 140,074 | A * | 6/1873 | Proctor | 108/8 |
| 175,323 | A * | 3/1876 | Baggs | 83/471.1 |
| 1,520,589 | A | 12/1924 | Matkovic | |
| 1,575,897 | A * | 3/1926 | Cole | 108/8 |
| 1,770,955 | A * | 7/1930 | Storm | 108/8 |
| 2,775,497 | A * | 12/1956 | Alvarez | 108/146 |
| 3,695,567 | A | 10/1972 | Weagle | |
| 4,238,100 | A * | 12/1980 | Shy | 248/439 |
| 4,781,126 | A * | 11/1988 | Lochridge | 108/6 |
| 5,036,776 | A | 8/1991 | Veyhl | |
| 5,109,778 | A * | 5/1992 | Berkowitz et al. | 108/127 |
| 5,172,641 | A * | 12/1992 | Auer | 108/5 |
| 5,226,250 | A * | 7/1993 | Ulmer et al. | 38/102.9 |
| 5,249,767 | A | 10/1993 | Mellen | |
| 5,626,393 | A * | 5/1997 | Levasseur et al. | 297/423.46 |
| 6,637,352 | B1 * | 10/2003 | Thode et al. | 108/132 |

* cited by examiner

*Primary Examiner*—José V Chen
(74) *Attorney, Agent, or Firm*—Fasth Law Offices; Rolf Fasth

(57) ABSTRACT

The device is a table with no wiggling motion, consisting of two pairs of legs (2, 3) for supporting a tabletop. At least one of the leg pairs (2) is motionless and resting with its middle-part (5) against the underside (6) of the tabletop (4). At the same time the other pair of legs (3) with its connecting middle-part (7) is movably attached to the underside (6) of the tabletop (4). The movably attached pair of legs (3) is adjustable as to the ground by tilting sideways in its own plane in relation to the underside of the table top, in order to compensate for possible unevenness in the ground, resulting in the two pairs of legs (2, 3) being able to carry the table top (4) in a wiggle-free way.

4 Claims, 7 Drawing Sheets

DEVICE FOR A WIGGLE-FREE TABLE

PRIOR APPLICATION

This application is a U.S. national phase application based on International Application No. PCT/US2005/035726, filed 5 Oct. 2005, claiming priority from Swedish Patent Application No. 0400994-0, filed 11 Oct. 2004.

FIELD OF THE INVENTION

This invention concerns a device for a non-wiggling table, consisting of two pairs of table legs for supporting a table top, where at least one table leg pair is motionless and rests with a connecting part against the underside of the table top, the other pair of legs being at the same time movably in contact with the underside of the table top.

BACKGROUND AND SUMMARY OF THE INVENTION

As is well-known, tables are mostly equipped with four legs. Tables standing on uneven ground, which is often the case when used outdoors, tend to wiggle in an irritating manner. As an example camping-tables may be mentioned but also tables intended for sidewalk or garden restaurants. There are different methods to solve the problem, one is to modify the length of one of the four legs by some kind of telescopic design, that is tubes or profiles being inserted into each other and locked together when achieving right length and the wiggling motion is eliminated. Other methods for solving the wiggling problem exist, where modifying the length of the table legs is attained by using threads.

Subject of this invention is to create a device of the kind mentioned in the introduction, which in an excellent way fullfills its purposes and in addition at the same time is not only easy but also cheap to fabricate. Distinguish characteristics of the invention are mentioned in patent claims to follow.

Thanks to the invention a device is created, solving the problem mentioned above, whereby the legs supporting a table top are connected to each other in pairs and at least one of the leg pairs can rotate mainly in its own plane and where, simultaneously, an angle appears between the table top and the pair of legs, resulting in all legs being supported against the ground, compensated for unevenness.

BRIEF DESCRIPTION OF THE DRAWINGS

The invention is described more in detail by means of an applied case, referring to enclosed drawings, in which.

DETAILED DESCRIPTION

Figure 1:
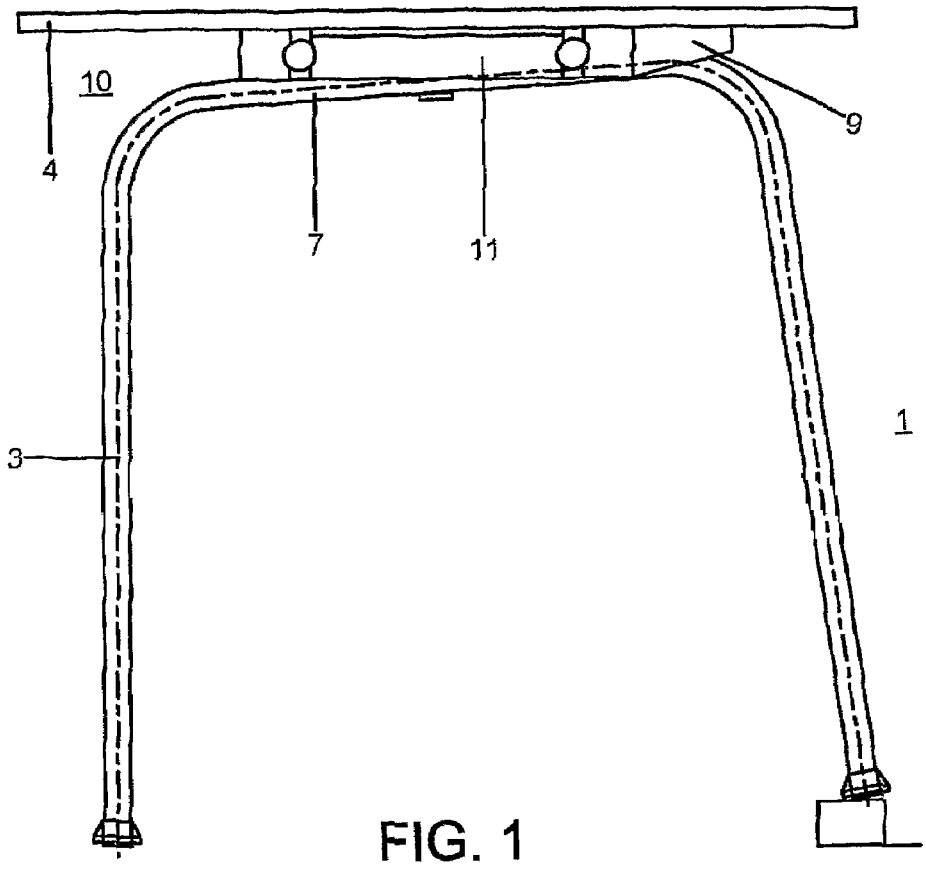
FIG. 1 shows a schematic end-view of a table according to a primary design of the invention, where one of the pairs of legs is adjustably positioned in relation to the underside of the table top, for compensating unevenness in the ground.

As is seen from FIGS. 1-7 a first, preferable design of the invention is here shown, where a table 1 is wiggle-free adjustable on the ground by means of a design according to the invention. Function of table 1 is shown more in detail in FIGS. 1 and 2, said table 1 in the shown case consisting of two pairs of legs for supporting a table top 4. In particular the table legs consist of pipes, bent in pairs in order to constitute the four legs of the table. One of the pair of legs 2, is motionless and rests with a straight middle-part 5 against the underside 6 of the table top 4 while the other pair of legs 3 with its straight middle-part 7 is movably attached to the underside 6 of table 4 by means of a system of wedges 11, consisting of at least one wedge 9 on each side of a carrier 8, supporting the middle-part 7. The wedge 9 is adjustably inserted into a slit 10 between the underside 6 of the table top 4 and the middle-part 7, said system of wedges consisting of two connected wedges 12 and 13, which are rotatable applied in relation to underside 6 of table top 4, and at the same time pressed against middle-part 7 of the movably attached pair of legs 3, in order to compensate for unevenness in the ground on which the table stands.

Figure 2:
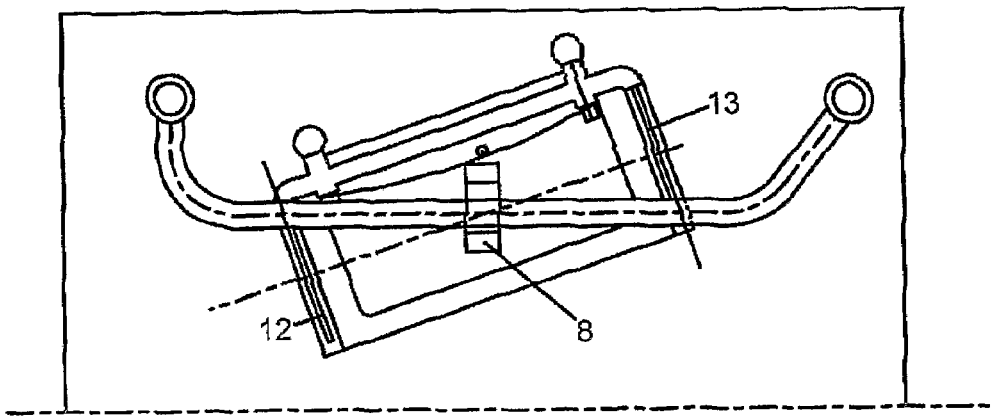
FIG. 2 shows a view from below of one half of the table shown in FIG. 1, consisting of that pair of legs which is adjustably positioned against the ground, and where wedges in form of an anti-wiggling mechanism by means of a spring blade changes the position of the pair of legs in relation to the underside of the table top in order to compensate for unevenness in the ground.

The system of wedges 11 constitutes an anti-wiggling mechanism 14 as is shown more in detail on FIG. 2, situated between underside 6 of table top 4 and the straight middle-part 7 of the leg pair 3, and this pair of legs 3 being in its middle supported by carrier 8; rotating of anti-wiggling mechanism 14 results in increasing the space between the straight middle-part 7 and underside 6 of table top 4 at the wedge 12 and decreasing the space at the other wedge 13, resulting in an angle between table top 4 and the movable pair of legs 3. Unevenness in the ground is hereby compensated and the table stands firmly on its four legs.

Figure 4:
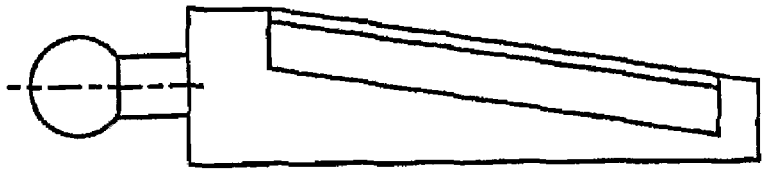
FIG. 4 shows a side-view of a wedge, integrated in the anti-wiggling mechanism according to FIGS. 2 and 3.
Figure 3:
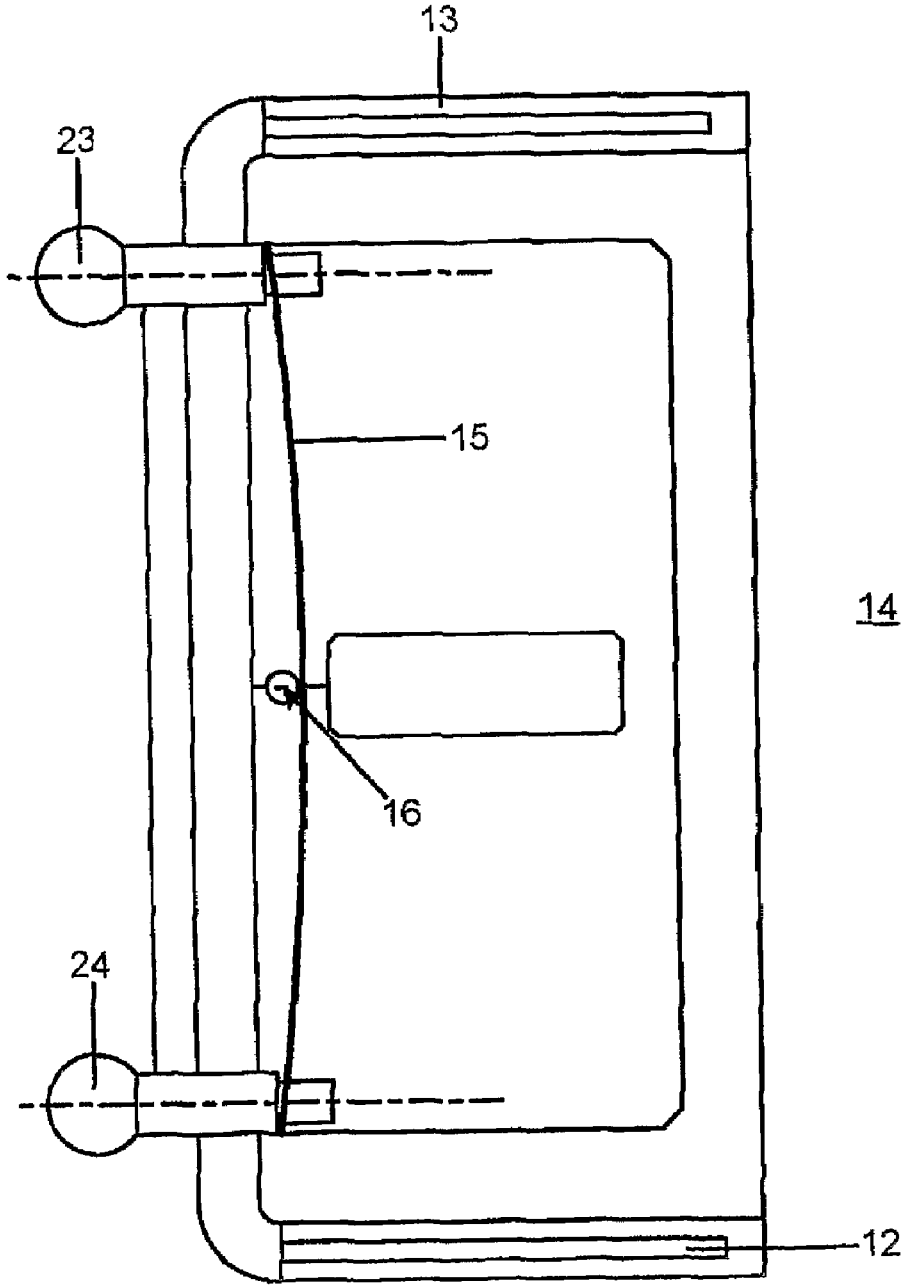
FIG. 3 shows the anti-wiggling mechanism from FIG. 2 in a larger scale.
Figure 5:
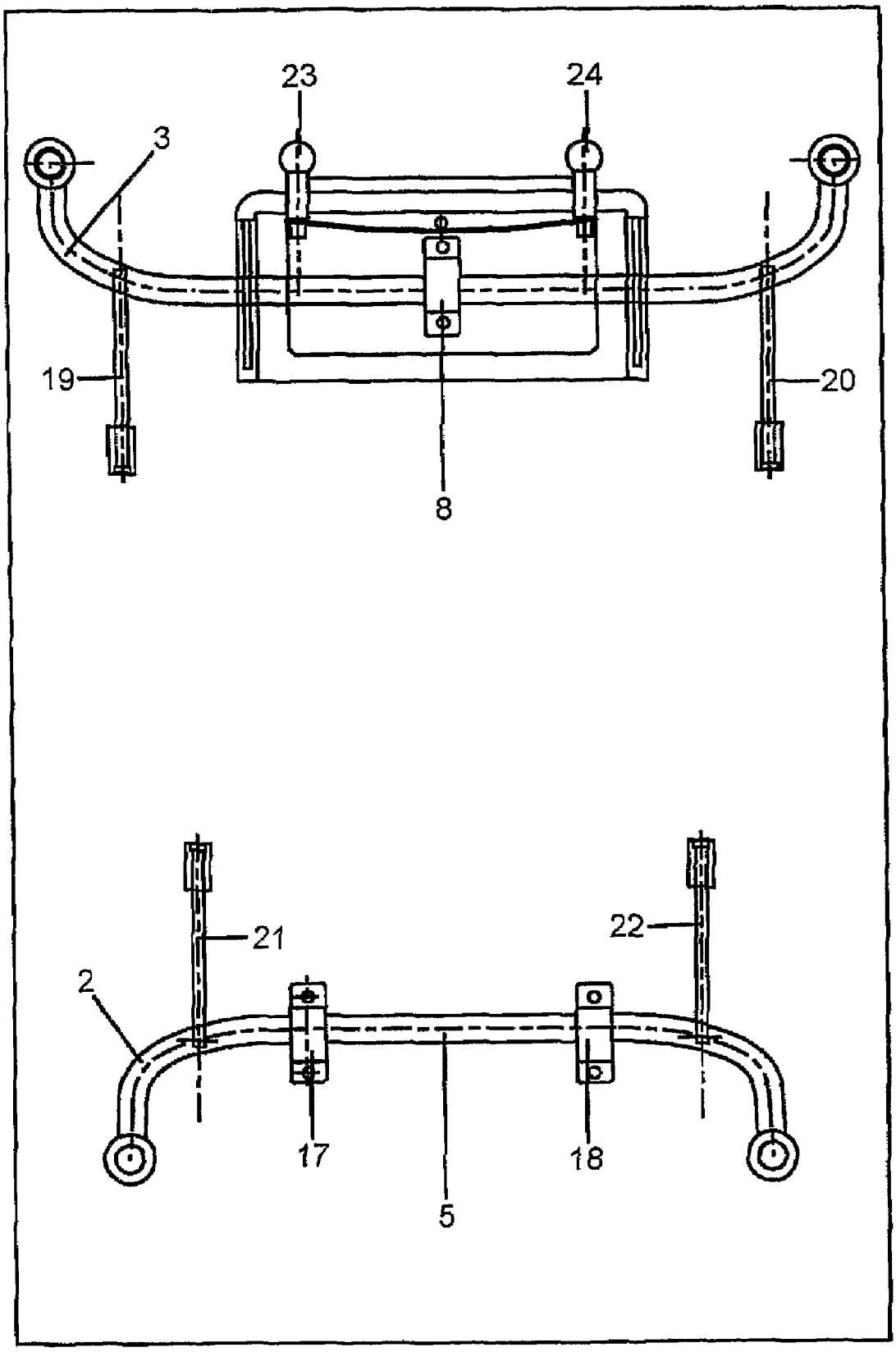
FIG. 5 shows a view from below of the table in FIG. 1, with the pairs of legs folded out, but where the anti-wiggling mechanism has a neutral position.

FIG. 3 shows an enlargement of the anti-wiggling mechanism 14 and FIG. 4 shows a wedge, integrated in this mechanism. In FIG. 5 table 1 is shown from below and from this picture it is also evident that the first pair of legs 2 is mounted in two carriers 17 and 18, therefore being unable to form an angle with table top 4.

In order to facilitate assembling of table 1 the carriers 8, 17 and 18 are designed with snap-in connection, enabling fast and simple erecting and down-folding of table 1. The pairs of legs 2 and 3 are attached to underside 6 of table top 4 by connecting bars 19 and 22, shown with an angle of inclination of 45 degrees.

Figure 6:
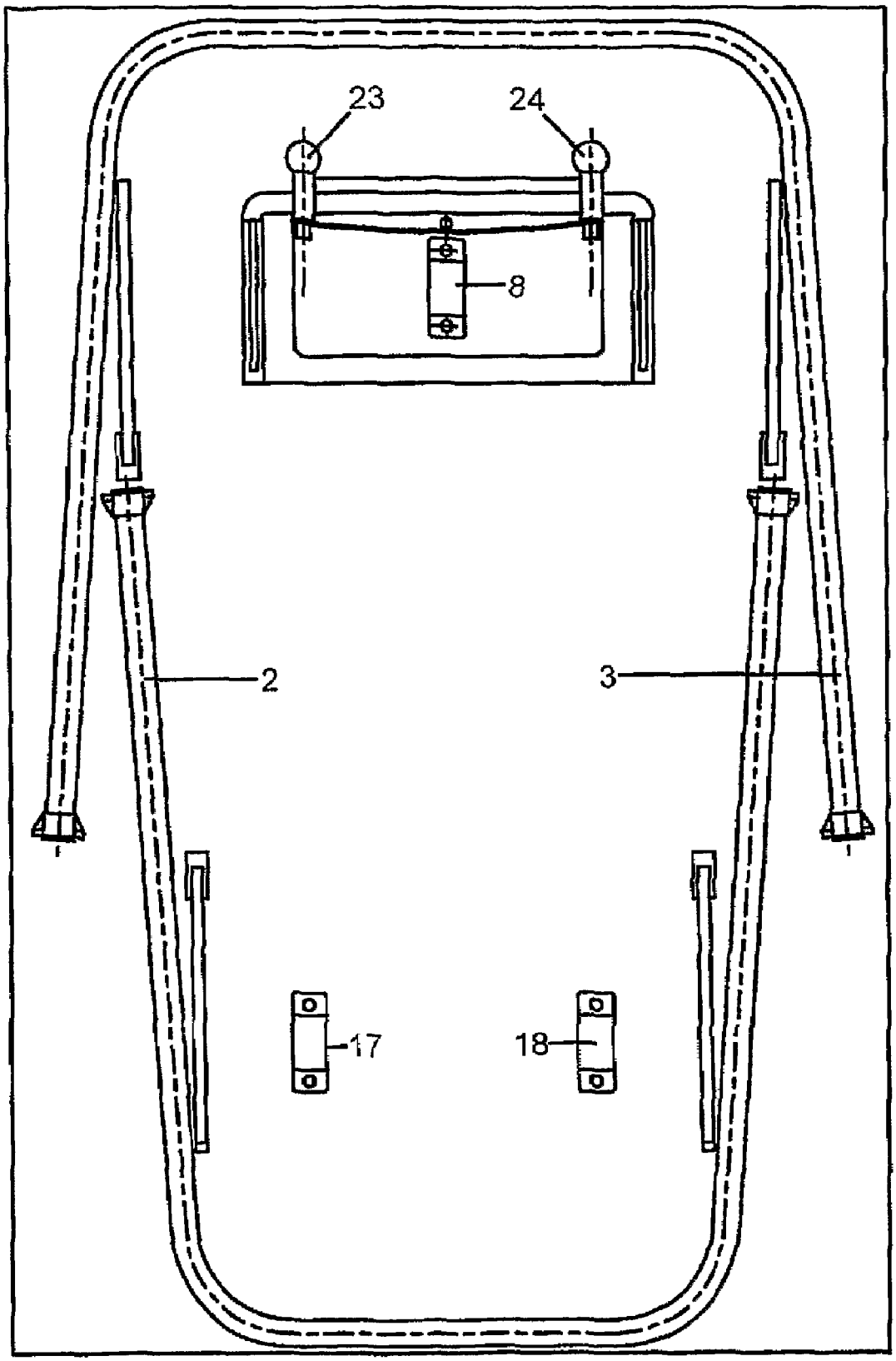
FIG. 6 shows a view from below of the table according to FIG. 1, where the pairs of legs are folded together on the underside of the table top.
Figure 7:
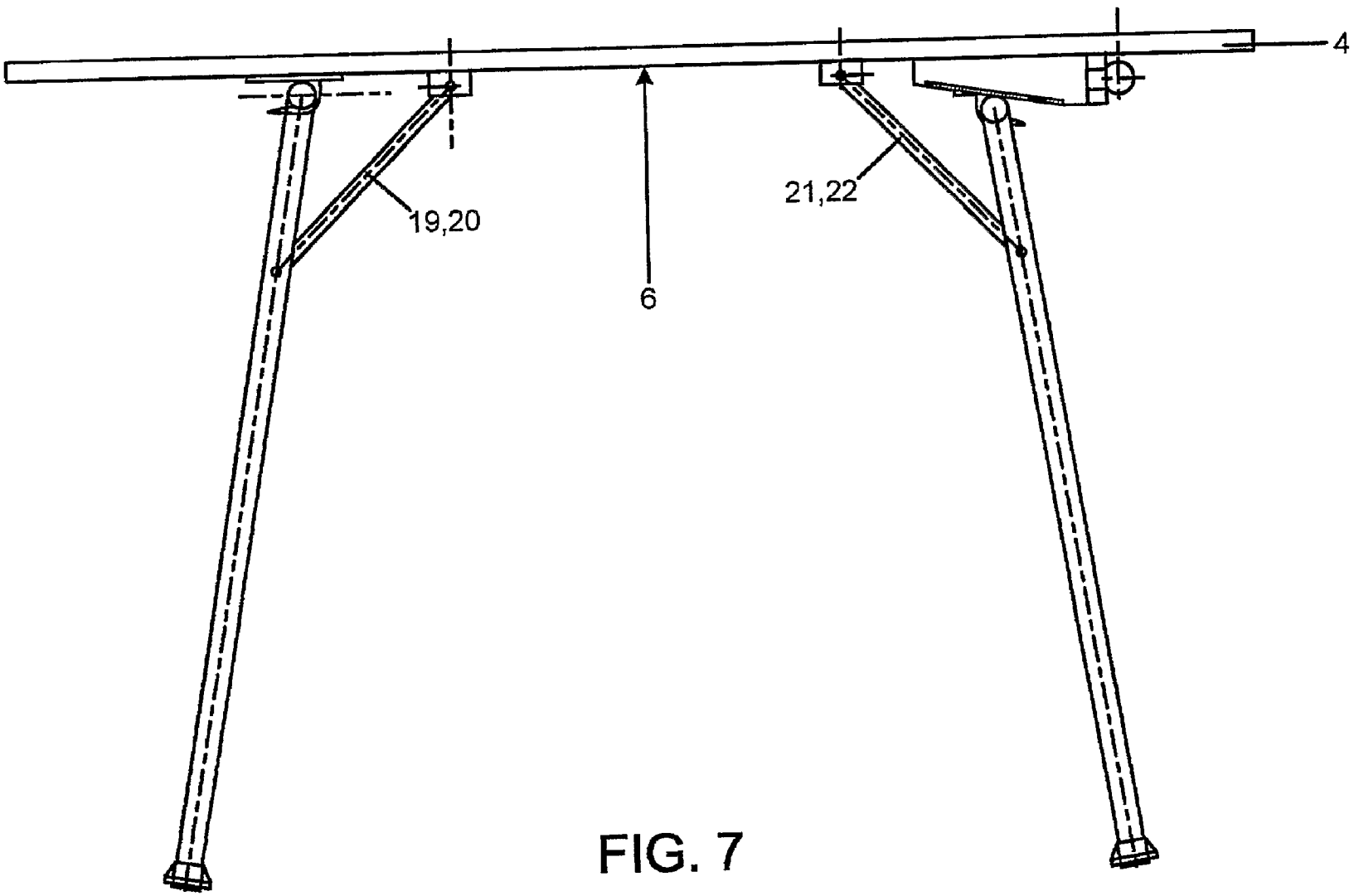
FIG. 7 shows a side-view of the table according to FIG. 1, where the pairs of legs are folded out from the underside of the table top.

As shown more in detail in FIGS. 2, 3 and 6 anti-wiggling mechanism 14 is held in place by a blade spring 15, engaged by a pin 16, driven at right angle into underside 6 of table top 4. Blade spring 15 presses the two wedges 12 and 13 of anti-wiggling mechanism 14 between underside 6 of table top 4 and the leg pair 3. Furthermore the anti-wiggling mechanism 14 can be turned and/or pushed sideways by using two handles 23 and 24.

Figure 8:
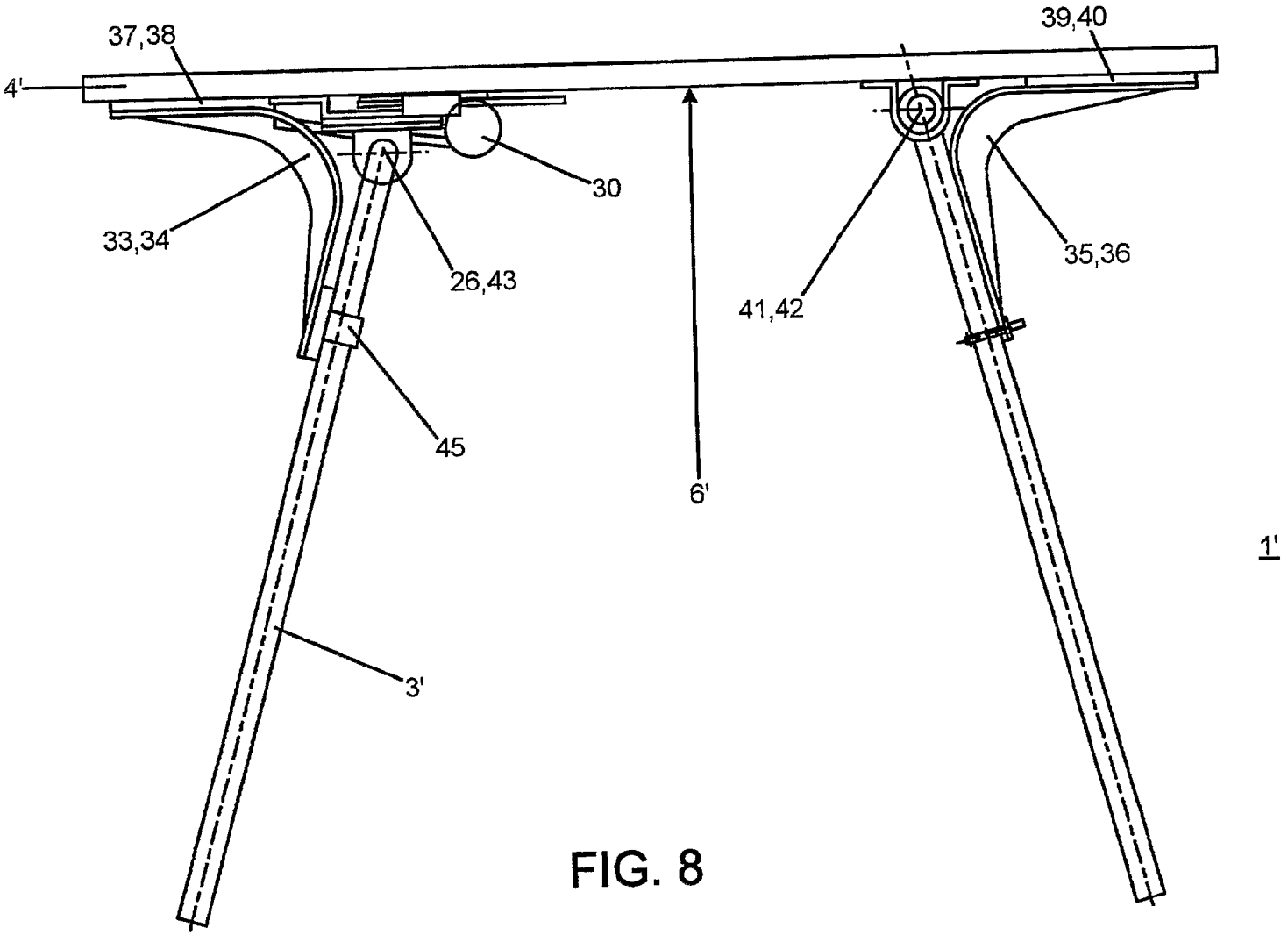
FIG. 8 shows in a side-view an alternate design of the invention, where one of the leg pairs of the table is adjustable in relation to the table top by means of an anti-wiggling mechanism which is revolved in a different way and which is pivoted in a point right under the carrier of the pair of legs and where the wedges are inserted over the pair of legs in opposite direction compared to what is shown in FIG. 2
Figure 9:
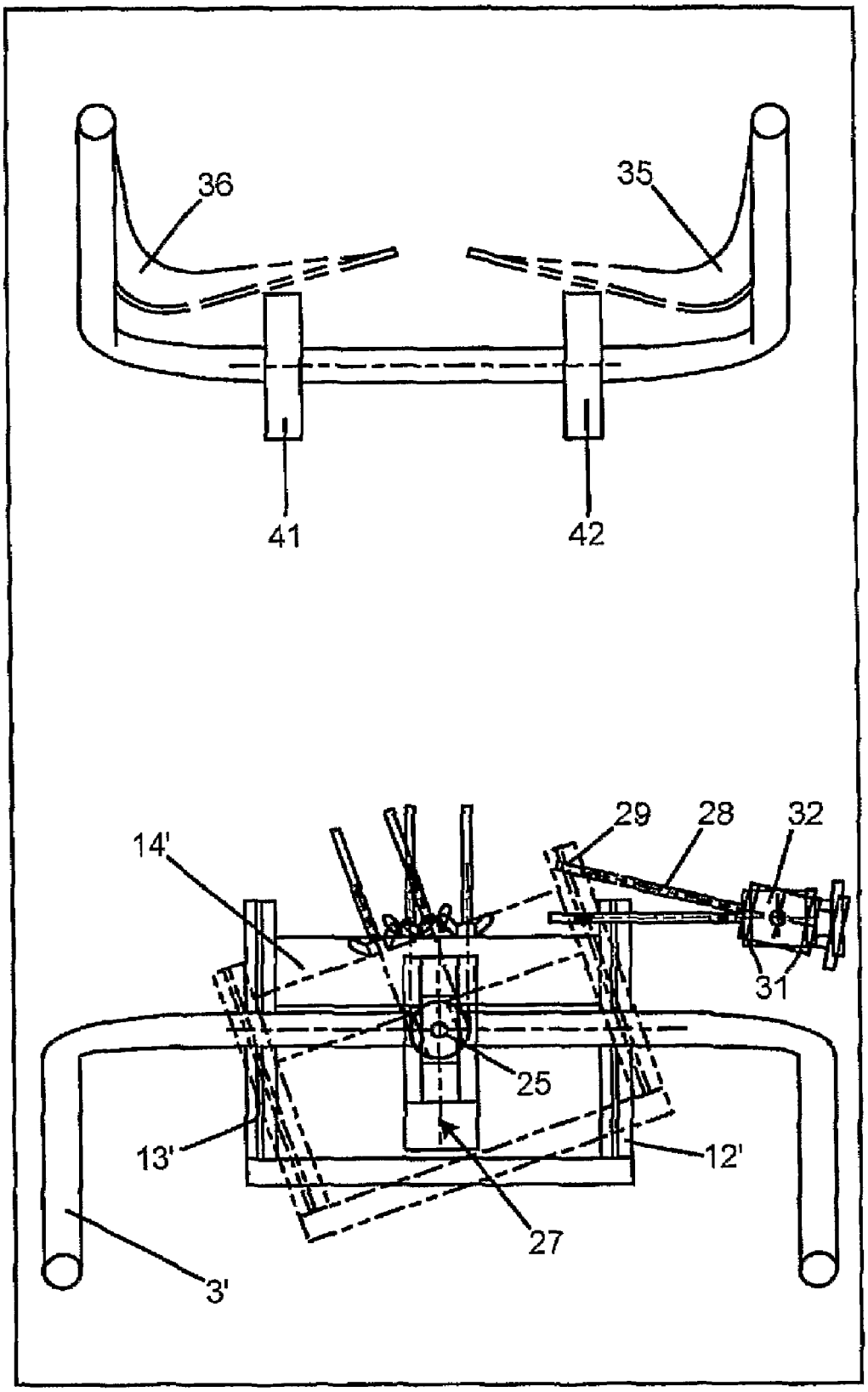
FIG. 9 shows a view from below of the table in FIG. 8, with the pairs of legs folded out.

FIGS. 8 and 9 show an alternate design of the table according to the invention, mainly intended for larger tables 1', for instance in sidewalk and garden restaurants. The basic principle for this design is the same as for the design already described, with the same anti-wiggling mechanism 14' with wedges 12', 13' applied between the table top 4' and one of the pair of legs 3', but the way of turning round the anti-wiggling mechanism 14' is different. As is shown more in detail in FIG. 9 the anti-wiggling mechanism 14' is mounted in a way making it able to be revolved in the horizontal plane around a point 25, placed right under the carrier 26 of the movable pair of legs 3', that is right under the intersection of middle-line 27 of carrier 26 and the center-line of the pipe. Furthermore it is turned around 180 degrees. The wedges 12' and 13' are being pushed over the leg pair 3' from other side, that is from the inside compared to the earlier described, first design. The motion is accomplished by means of a design involving screw 28 and nut 29. The screw 28 is turned around by using a small wheel 30 just under the edge of the table and the nut 29 is flexibly applied in one wing of anti-wiggling mechanism 14'. The nut 29 is cylindrical with a threaded hole in the middle, at right angle of the cylinders longitudinal direction. The screw 28 is inserted and mounted in both flanges 31 of a U-profile 32, which in turn is attached to underside 6' of table top 4' and is turnable in the horizontal plane. Flexibility makes the screw 28 follow when anti-wiggling mechanism 14' is turned around.

Also this table is collapsible, in order to attain small storage space when the tables are stowed away. It is intended for outdoor-restaurants and is erected and down-folded once every season. The leg pairs 2' and 3' are supported by heavy brackets 33-36, mounted in heavy hinges 37-40. When erecting table 1', the leg pairs 2' and 3', mounted in cylindrical bearings 41-43 without snap-in function, are lowered at first, then the consoles 33-36 are turned upwards, supporting the legs. One of the pair of legs 2' is for the out-door season permanently attached to its consoles 33 and 34 by for instance U-bolts. The other pair of legs 3', which is turnable in its own plane, is attached to the consoles 35 and 36 by means of a carrier 45 with snap-in function. The carrier 45 is fabricated in plastics and secured by screws to the hinged console. The plastics elasticity makes it possible to twist the leg pair 3'. The advantage of using consoles is apparent, because in spite of the collapsible table there are no hindering brackets between the table top and the pairs of legs, leaving plenty of room for the limbs of persons sitting at the table.

While the present invention has been described in accordance with preferred compositions and embodiments, it is to be understood that certain substitutions and alterations may be made thereto without departing from the spirit and scope of the following claims.

The invention claimed is:

1. A device for a wiggle-free table comprising: a table top two pairs of legs (2, 3) for carrying a table top (4), where at least one of the pairs of legs (2) is resting with a middle-part (5) against an underside (6) of the table top (4) where at the same time the other pair of legs (3) with a connecting middle-part (7) is movably attached to the underside (6) of the table top (4) by an anti-wiggling mechanism rotatably connected to said underside of said table top along an axis essentially perpendicular to a plane defined by the undersurface of said table, top said movably attached pair of legs (3) connected to said anti-wiggling mechanism by a carrier, a pair of wedges adjustably positioned between said anti-wiggling mechanism and said underside of said table top so that the legs are sideways tiltable relative to the underside of the table top, resulting in the two pairs of legs (2, 3) being able to carry the table top (4) in a wiggle-free way.

2. The device according to claim 1 wherein the wedge (9) is designed as a system of wedges (11) consisting of two connected wedges (12, 13) and being pressed against the middle-part (7) of the movably attached pair of legs (3), at which said pair of legs (3) with middle-part (7) belonging to it, by turning the wedges (12, 13) forms an angle between the underside (6) of the table top (4).

3. The device according to claim 1 wherein said wedges (11) is held in place by means of a blade spring (15), engaged by a pin (16), attached at right angle to the underside (6) of the table top (4), said blade spring being arranged to press the two wedges (12, 13) of the anti-wiggling mechanism (14) in between the underside (6) of table top (4) and the middle-part (7) of the pair of legs (3) in question, for adjustment of the movable pair of legs (3) to the ground.

4. The device according to claim 1 wherein the middle-parts (5, 7) of the pairs of legs respectively are designed with straight shapes.

* * * * *